US005120253A

United States Patent [19]

Gelardi

[11] Patent Number: 5,120,253

[45] Date of Patent: Jun. 9, 1992

[54] CONNECTORS FOR FORMING STRUCTURES

[76] Inventor: John A. Gelardi, Rocky Pasture, P.O. Box 213, Cape Porpoise, Me. 04014

[21] Appl. No.: 669,028

[22] Filed: Mar. 13, 1991

[51] Int. Cl.[5] ..... A63H 33/10

[52] U.S. Cl. ..... 446/77; 446/126; 446/109

[58] Field of Search ..... 446/120, 121, 122, 107, 446/80, 109, 126, 77, 71

[56] References Cited

U.S. PATENT DOCUMENTS

| | | | |
|---|---|---|---|
| 1,216,840 | 2/1917 | Ramsey et al. | 446/122 |
| 2,885,822 | 5/1959 | Onanian | 446/121 |
| 3,528,079 | 9/1970 | Birch . | |
| 3,640,018 | 2/1972 | Light | 446/77 |
| 3,713,247 | 1/1973 | Parrilla | 446/71 |
| 3,890,022 | 6/1975 | Moon . | |
| 3,940,142 | 2/1976 | Hinz et al. | 446/109 X |
| 4,003,144 | 1/1977 | Maddestra et al. | 446/122 X |
| 4,129,975 | 12/1978 | Gabriel | 446/126 X |
| 4,170,082 | 10/1979 | Freedman | 446/126 X |
| 4,484,407 | 11/1984 | Petersson | 446/122 |

FOREIGN PATENT DOCUMENTS

| | | | |
|---|---|---|---|
| 825518 | 12/1951 | Fed. Rep. of Germany | 446/124 |
| 2129763 | 12/1972 | Fed. Rep. of Germany | 446/122 |
| 2154544 | 5/1973 | Fed. Rep. of Germany | 446/124 |
| 613144 | 11/1960 | Italy | 403/173 |
| 281162 | 2/1952 | Switzerland | 446/124 |
| 798278 | 7/1958 | United Kingdom . | |
| 1238975 | 7/1971 | United Kingdom | 446/124 |

*Primary Examiner*—Mickey Yu
*Attorney, Agent, or Firm*—James Creighton Wray

[57] ABSTRACT

A cube junction connector comprises six cylindrical receivers which extend from the cube and into which bottle caps can be inserted and locked. The cube is constructed from a flat cruciform blank with living hinges between square panels, comprising the cylindrical receivers. The panels are folded into a cube and locked together using male snaps interfitted with female snap receivers. A flange circumventting the edge of the cylinder, acting as a lock, holds and secures the bottom of the bottle cap in the cylinder. Rivets comprise two male snap members secured to one another at a base, and may be divided into two parts to allow for flexibility. The rivets are used in preformed openings in the bases of the bottles and secure one bottle base to another bottle base. Plastic bottles are joined together as building elements for structures.

13 Claims, 8 Drawing Sheets

FIG. 1
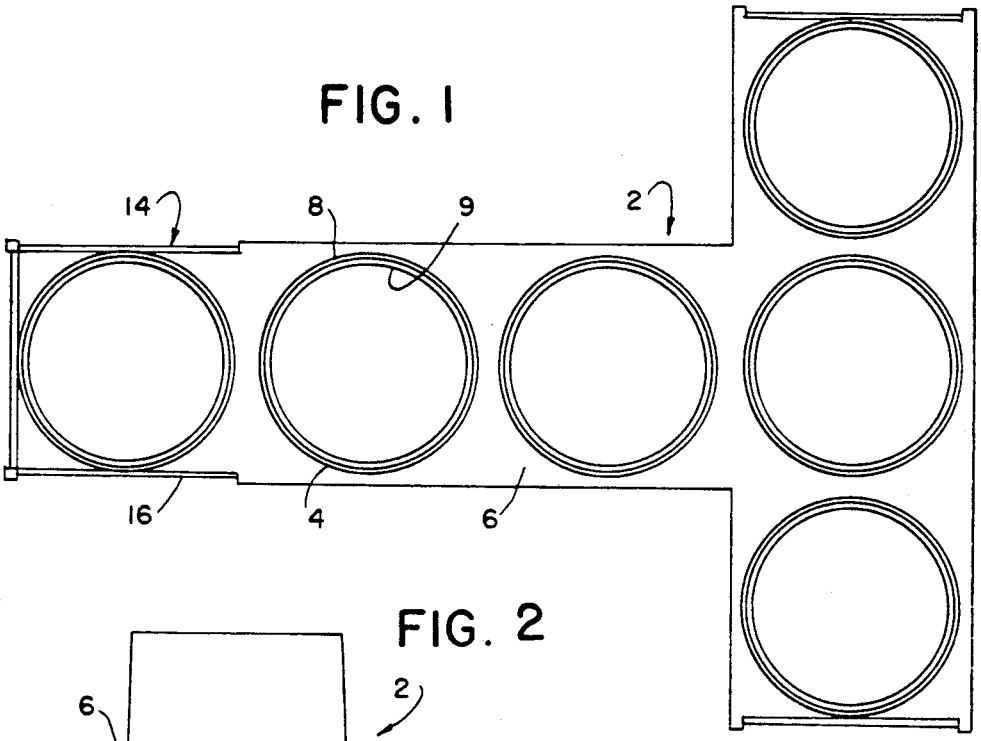
FIG. 2
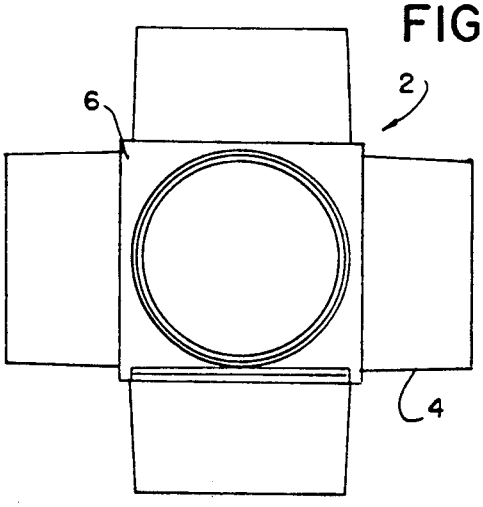
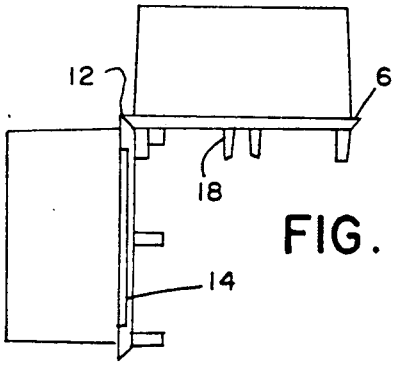
FIG. 3
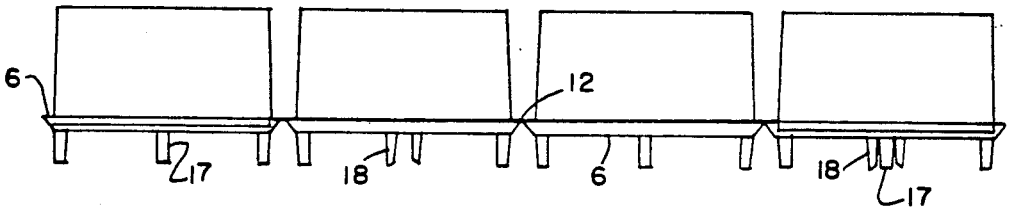
FIG. 4

FIG. 5
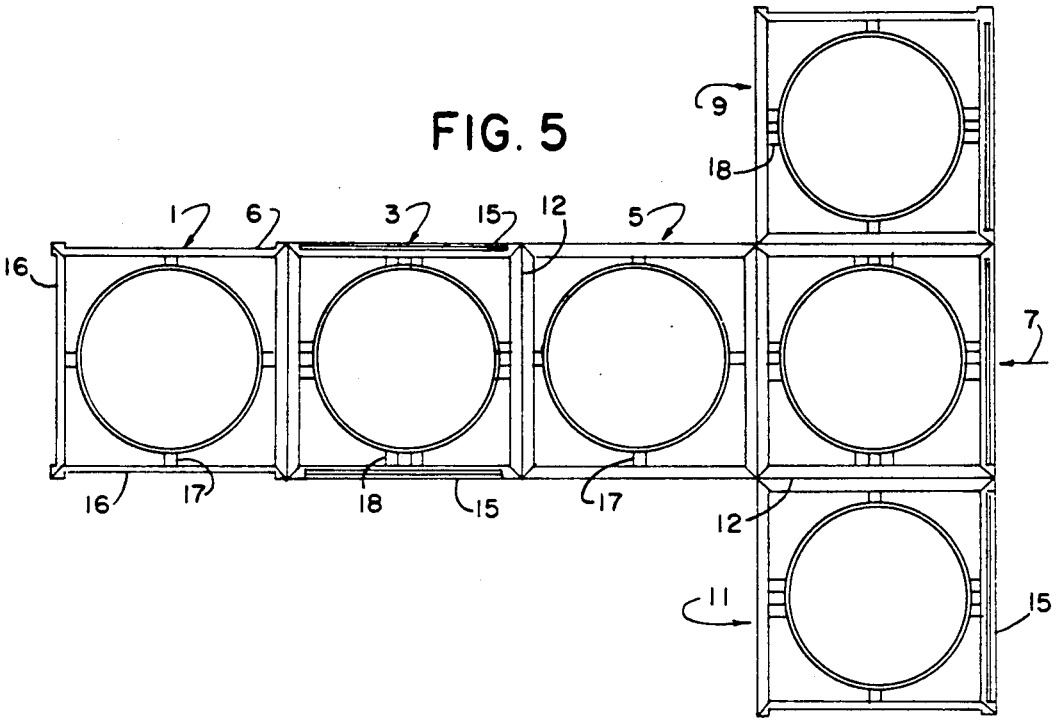
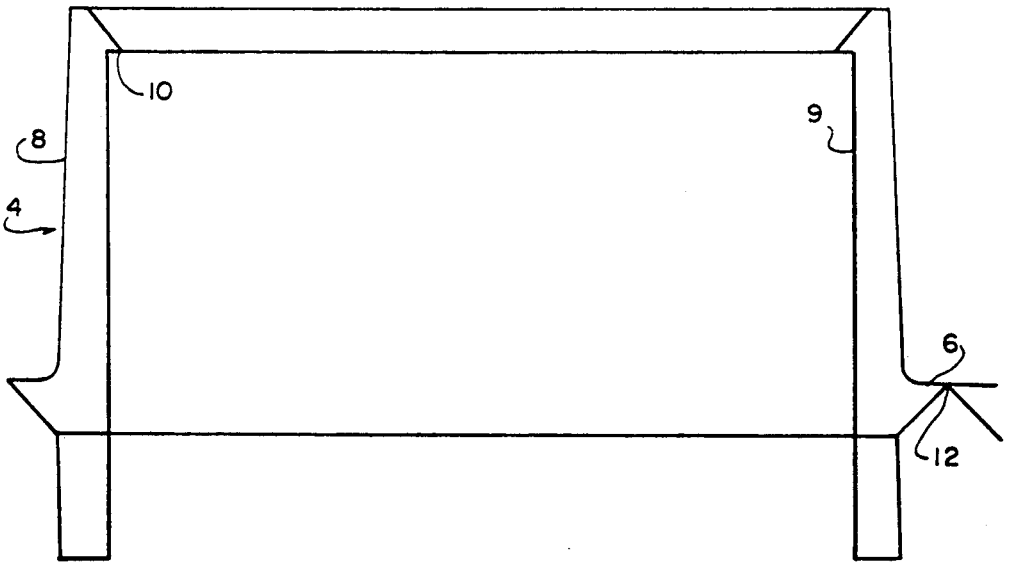
FIG. 6

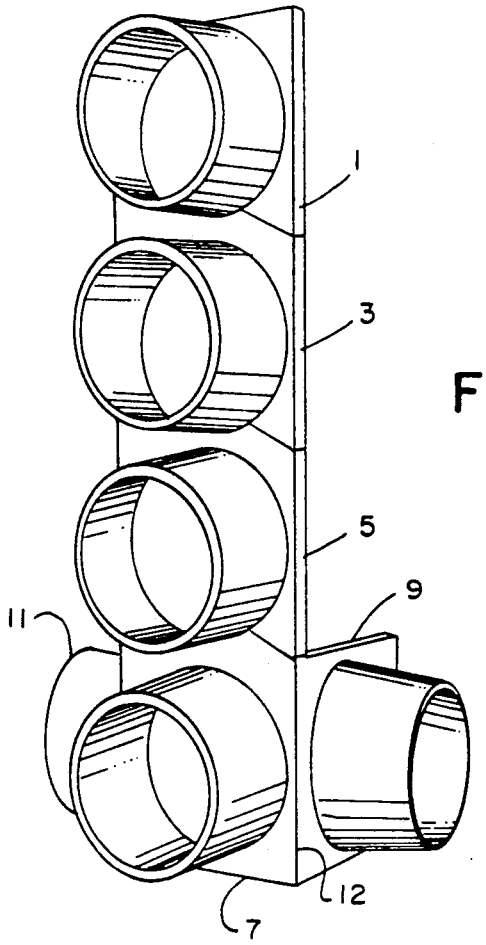
FIG. 8
FIG. 9
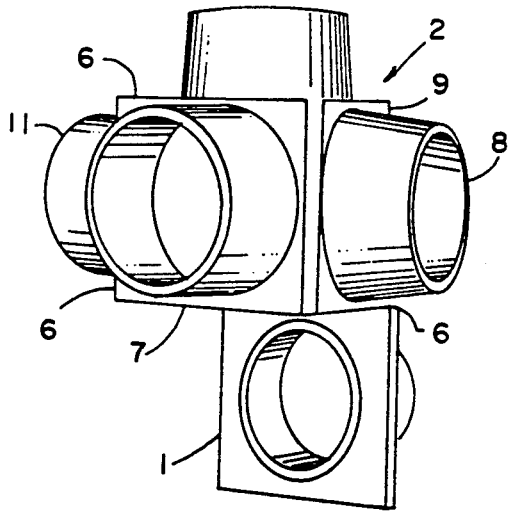

CONNECTORS FOR FORMING STRUCTURES

BACKGROUND OF THE INVENTION

Because of the recent surge in ecological consciousness, alternative uses of disposable items are constantly being considered. Plastics have been noted to be among the worst offenders. Plastics cause many of the present landfill problems because of their inability to break down over time and their releasing of harmful particles and gases into the atmosphere when burned. Although recycling efforts have increased, plastics are neither as popular to recycle nor as easy to recycle as glass, paper or aluminum.

A need exists to promote recycling through reuse of existing plastic products.

SUMMARY OF THE INVENTION

The invention provides a connector system for interconnecting plastic bottles for creating structures or for use as toy building blocks. Although not generally considered reliable building materials for construction toys, plastic bottles have been discovered to be durable, sturdy and lightweight building blocks when filled with air and capped.

This invention takes advantage of the flexibility and durability of plastic bottles for use as building blocks.

The present invention discloses a cruciform junction connector, comprising six square sections connected by living hinges. Six cylindrical receivers extend from the square sections. Bottle caps are inserted and locked into the receivers after bottles are filled with air and securely capped. The sections can be folded into various polygonal shapes, including a cube, and locked together. The cylindrical receivers comprise flange extensions with snaps within the apertures for securing the bottle caps in the openings.

Rivets are made of two male snap members secured to one another at a base. The snaps may be divided into two parts to allow for flexibility. The rivets are used in preformed openings in the bases of the bottles, and secure one bottle base to another bottle base.

These and further and other objects and features of the invention are apparent in the disclosure, which includes the above and ongoing written specification, with the claims and the drawings.

BRIEF DESCRIPTION OF THE DRAWINGS

FIG. 1 is a top view of the unfolded construction blank for the connector cube in cruciform shape showing the six receiver apertures.

FIG. 2 is an elevation showing the finished assembly of the cube.

FIG. 3 is a detail of two panels in a folded position, demonstrating the living hinge and interconnected snaps.

FIG. 4 is a side elevation of the unfolded cube blank of FIG. 1 showing the snaps on each individual panel.

FIG. 5 is a bottom view of the unfolded cube blank in cruciform shape showing the snaps on the individual panels and the receiving apertures on the individual panels.

FIG. 6 is a cross-sectional detail of a single panel and extended receiver, showing a bottle cap-holding lip.

FIG. 8 is a perspective view of the connector showing two side panels folded inward and the four remaining panels facing the same direction and aligned before bending.

FIG. 9 is a perspective view of a partially assembled cube.

DETAILED DESCRIPTION OF THE DRAWINGS

Figure 7:
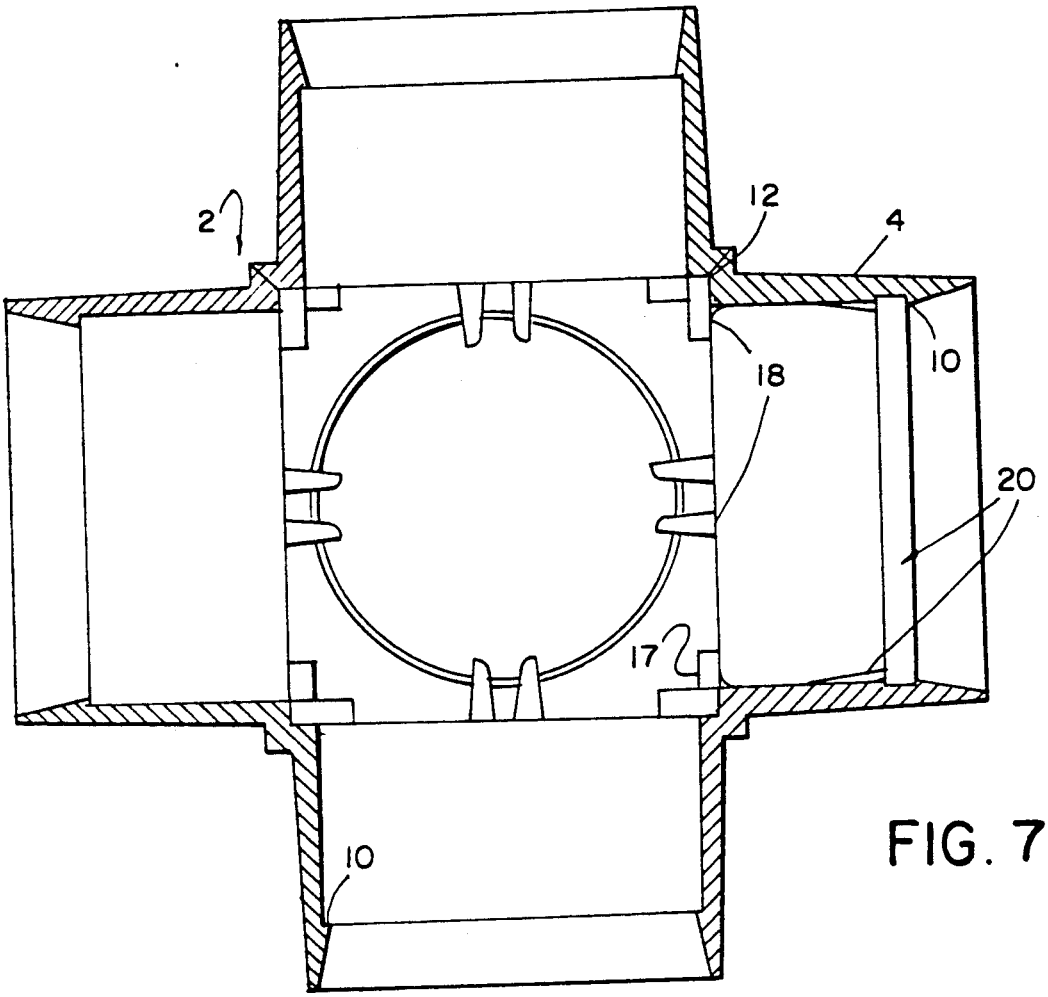
FIG. 7 is a cross-sectional view of the assembled cube showing the positioned snaps, arms for preventing the bottle cap from falling into the center of the cube, and the neck of a bottle cap inserted into a receiving aperture.

Referring to FIGS. 1 and 2, a connector is generally referred to by the numeral 2. Connector 2 is shown as a flat molded blank in cruciform shape in FIG. 1. Receivers 4 are formed on individual panels 6. Receivers 4 are formed with cylindrical walls 8 around apertures 9. The receivers are integrally formed with panels and surround the apertures for receiving conventional bottle caps. Lip portions 10 along outer edges of the cylindrical walls 8 fit around the open ends of the bottle caps for holding and securing the bottle caps in the connector. Living hinges 11 between panels 6 allow the square panels to fold into a unitary cube.

FIG. 2 shows the individual panels folded into a cube 12. Cylinders 8 extend oppositely along orthogonal X, Y and Z axes and surround the apertures 9, which extend through the cube.

Living hinges 12 are folded to form 90° angles, as shown in FIG. 3. Snaps 14 are attached along the edges of the individual panels 6. The snaps have two forms, male snaps 15 and female snap receivers 16 located on edges of four of the panels 6 of the cube 2.

FIG. 4 shows a side view of an unfolded, molded form of the joint connector, wherein the male guides 17 are attached to one panel 6, and female guides 18 are formed on other panels. The snaps and guides are positioned on panels so that they may be joined when the panels are folded into a cube. Guides shown interconnected in FIG. 3 are used to align adjacent panels with one another when the panels are folded at 90° angles and prevent the bottle cap from entering or falling inside the cube.

The living hinges 12 are recessed on the undersides of the panels in an upside-down V-shaped formation, so that when the panels 6 are folded into a cube, the sides of the hinges 6 are flush with one another and the panels are aligned at 90° angles, as shown in FIG. 3.

A bottom view of the connector in a flat molded cruciform shape is shown in FIG. 5. The living hinges 12 are formed between each individual panel. Male snaps 15 and female snap receivers 16 are shown on some panels. Two panels numbered 1 and 5 have only male guides 17, and two panels 3 and 7 have only female guides. End panels 9 and 11 of the tee cap have both male and female guides. The female mated snaps 16 on panel 1 receive the male snaps located on panels 7, 9 and 11. The sides of the panels become flush at 90°, as is shown in FIG. 3. The construction of the block continues with the guides on panel 5 fitting into the adjacent receiver guides located on panels 7, 9 and 11. The male guide on panel 1 of the far end of the cruciform, and the guide receiver on panel 7 at the opposite end, are fitted together to form a closed cube. Panels 9 and 11 are folded and guides 14 on panels 9 and 11 are fitted within adjacent guide receivers 16 on panel 7. The additional guides and guide receivers on panels 9 and 11 are interfitted with the guide receivers and guides 16 facing on panels 1, 3 and 5.

FIG. 6 is a cross-sectional detail of one extending cylinder 8 which forms a cap receiver 4. Ramped flange extension 10, otherwise known as an interior lock, extends from the end of the cylinder and into the aperture. The flange extension 10 extends around the entire cylinder, and secures and holds a bottle in place by locking around the bottom edge of the bottle cap. The ramp on the extension promotes slight expansion of the receiver to accept the cap.

A cross-sectional view of the inside of the cube 2 with a bottle cap 20 inserted inside one receiver is shown as FIG. 7. The cap 20 is secured in the cylinder by the flange extension 10, and is prevented from entering the center of the cube 2 by the guides which extend from the adjoining sections of the cube 2. The mated guides and guide receivers, when interfitted, thereby prevent the bottle cap 20 from falling into the center of the cube 2.

FIG. 8 shows a perspective side view of the molded shape having panel members 9 and 11, as referred to in FIG. 5, folded inward forming 90° angles with panel 7 along the adjoining hinges 12.

FIG. 9 shows a partially assembled cube 2, wherein five of the sections 6 are locked together in order to form a sturdy and durable joint connector. The receivers 8 and apertures are open to different sides, and can accommodate bottles from different directions.

Figure 10:
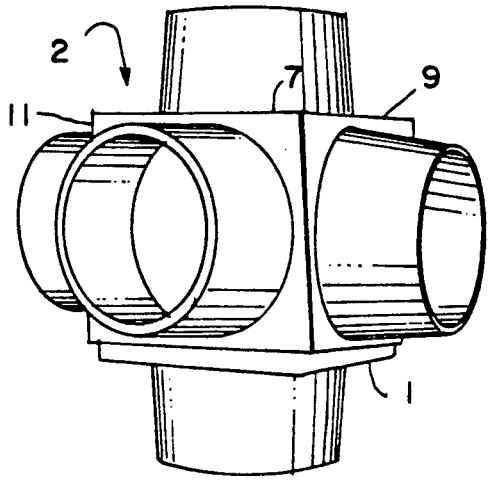
FIG. 10 is a perspective view of the assembled joint connector.

FIG. 10 shows an assembled cube, wherein the end panel has been secured to and locked into the opposite end panels 7, 9 and 11. An alternate use for the joint connector is as a corner joint or a joint connector which may secure two bottles in the same direction.

Figure 11:
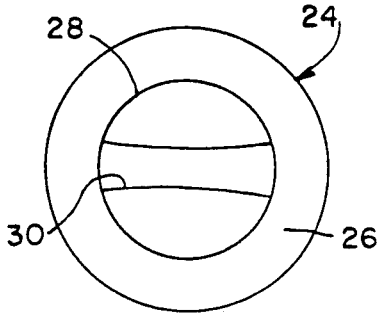
FIG. 11 is an end view of the rivet.

FIGS. 11-15 show a preferred the rivet assembly 24 of the connector system. The end view of the rivet, as shown in FIG. 11, shows the intermediate disc 26 to which bases of two male rivets 28 are attached on either side. This view shows one of the male rivets 28 split into two parts, creating a hollow center 30 for flexibility.

Figure 12:
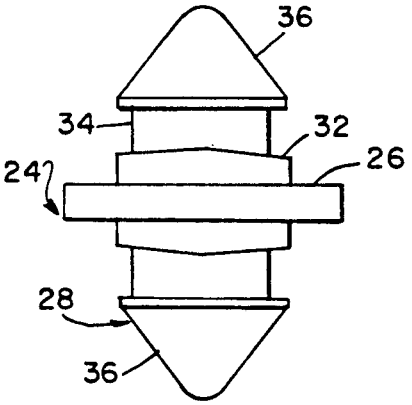
FIG. 12 is a front elevation of the rivet.

A side view in FIG. 12 illustrates the two male rivets 28 attached to the disc 26. The male rivets are joined to the disc at base 32 and extend outward away from the disc by shaft 34. The head 36 of the rivet assembly 24 is attached to the shaft 34. The head 36 at its base 38 is slightly wider than the shaft 34, creating a flange 40 for locking into a preformed opening in the cup-like base of the plastic bottle. The base 32 is also slightly wider than shaft 34, allowing the sides of the preformed opening in the bottle base cup to be caught and secured between the base 32 and the head 36.

Figure 13:
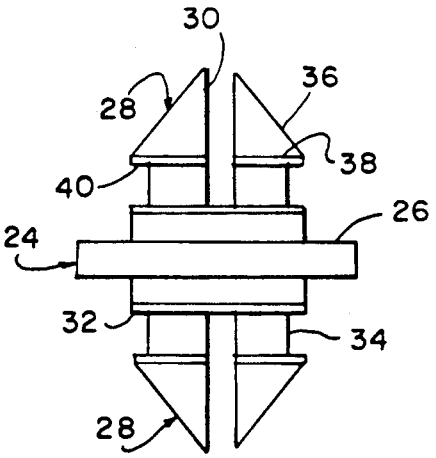
FIG. 13 is a side view of the rivet showing the individual male snaps divided into two sections.

FIG. 13 is an elevation of the rivet showing disc 26 and male rivets 28. The rivets 28 are divided into two parts by an opening 30 in the center of the rivets 28, allowing the rivets 28 to be flexible. The two parts of the rivet 28 can be closed together to allow the head 36 of the rivet 28 to be easily inserted into a preformed opening. After the head 36 and flange 40 have been inserted into the preformed opening, the two parts of the rivet 28 spring apart, applying pressure to the sides of the opening and locking the flange 40 in the opening 46, as shown in FIG. 15.

Figure 14:
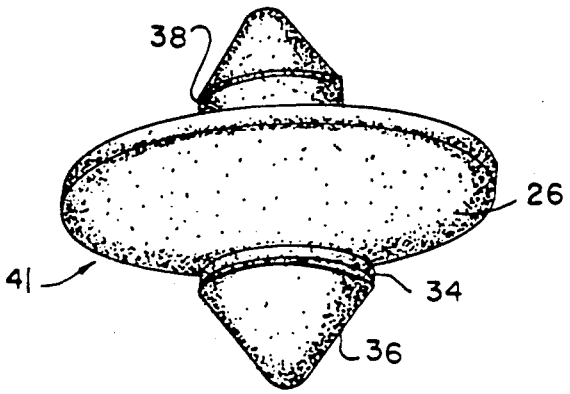
FIG. 14 is a perspective view of the rivet.

FIG. 14 is an alternate rivet 41, wherein shaft portions 34 are formed from the disc 26 and attach to head portions 36. Each head portion has a base 38 wider than the shaft portion 34, forming a flange 40 for catching and securing the sides of a preformed opening between the head 36 and the disc 26. The rivet 41 is a solid rivet with a solid shaft 34 and solid head 36. Alternatively, the shaft and head may be slit axially and separated radially.

Figure 15:
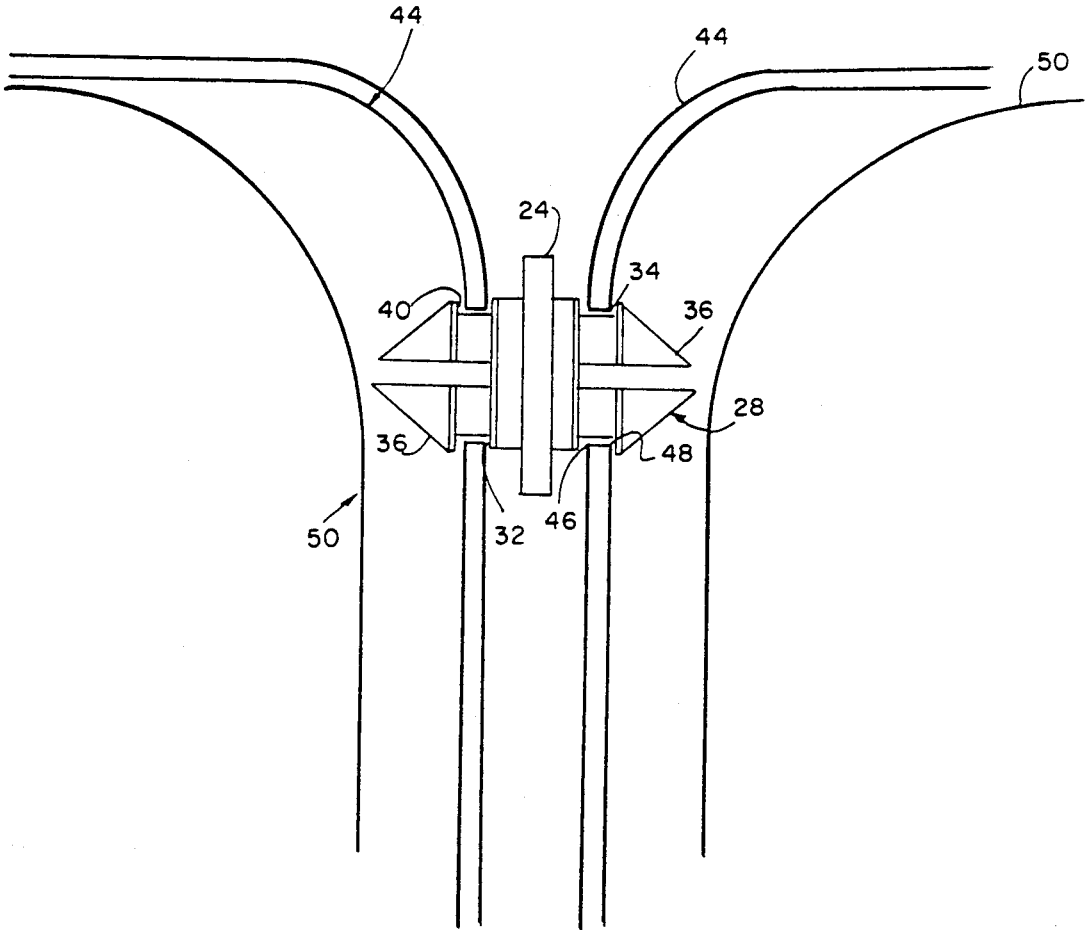
FIG. 15 is a side view detail of a single rivet adjoining the base cups of two plastic bottles.

FIG. 15 shows a rivet, wherein the heads 36 of the rivet 28 have been inserted into the preformed openings 46 in the base cups 44 of adjacent plastic bottles 50. The flange 40 of the head 36 of rivet 28 holds the rivet inside the preformed openings 46. The sides of the preformed openings 46 are secured between the flange 40 and the base 32, preventing movement of the plastic bottles. When inserted into the preformed openings 46, the rivets 28 are created with a trunk portion 34, having a width equal to that of the width of the sides 48 of the preformed openings 46. The length of the trunk 34 is also of a specific length in order to maintain a distance between the base 44 of the plastic bottle and the bottom of the plastic container 50.

The rivets are sufficiently strong to hold the bottles assembled under axial loading but may be designed to easily twist out of the base cup openings to discourage climbing on the structures.

Figure 16:
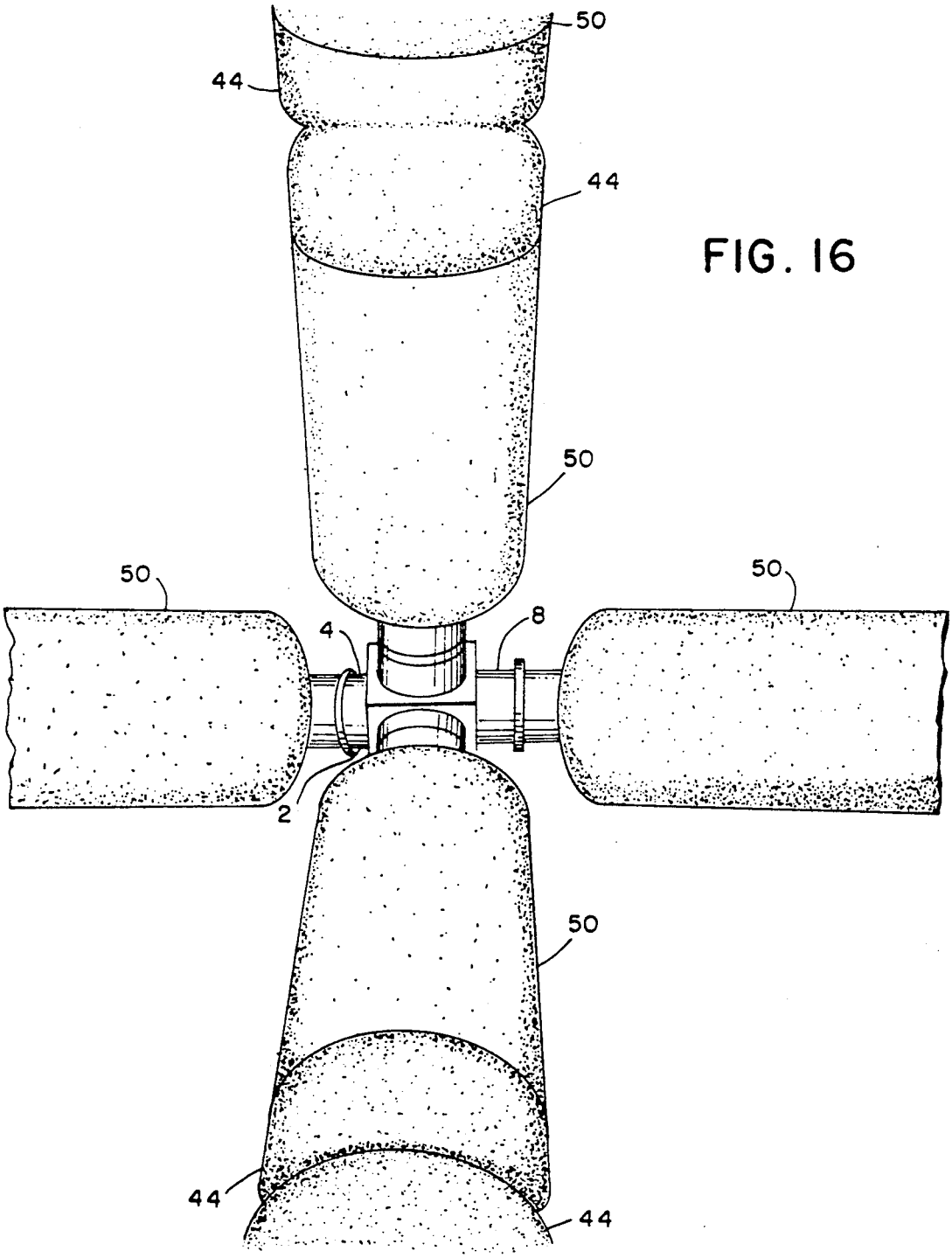
FIG. 16 is a perspective view demonstrating the attachment of four bottles into the cube.

FIG. 16 is a schematic detail of a cube 2 connecting four bottles in different directions. The receivers engage the four bottle caps securing them to the cube 2. Two of the bottles 50 have further bottles connected by rivets through abutting base cups.

Figure 17:
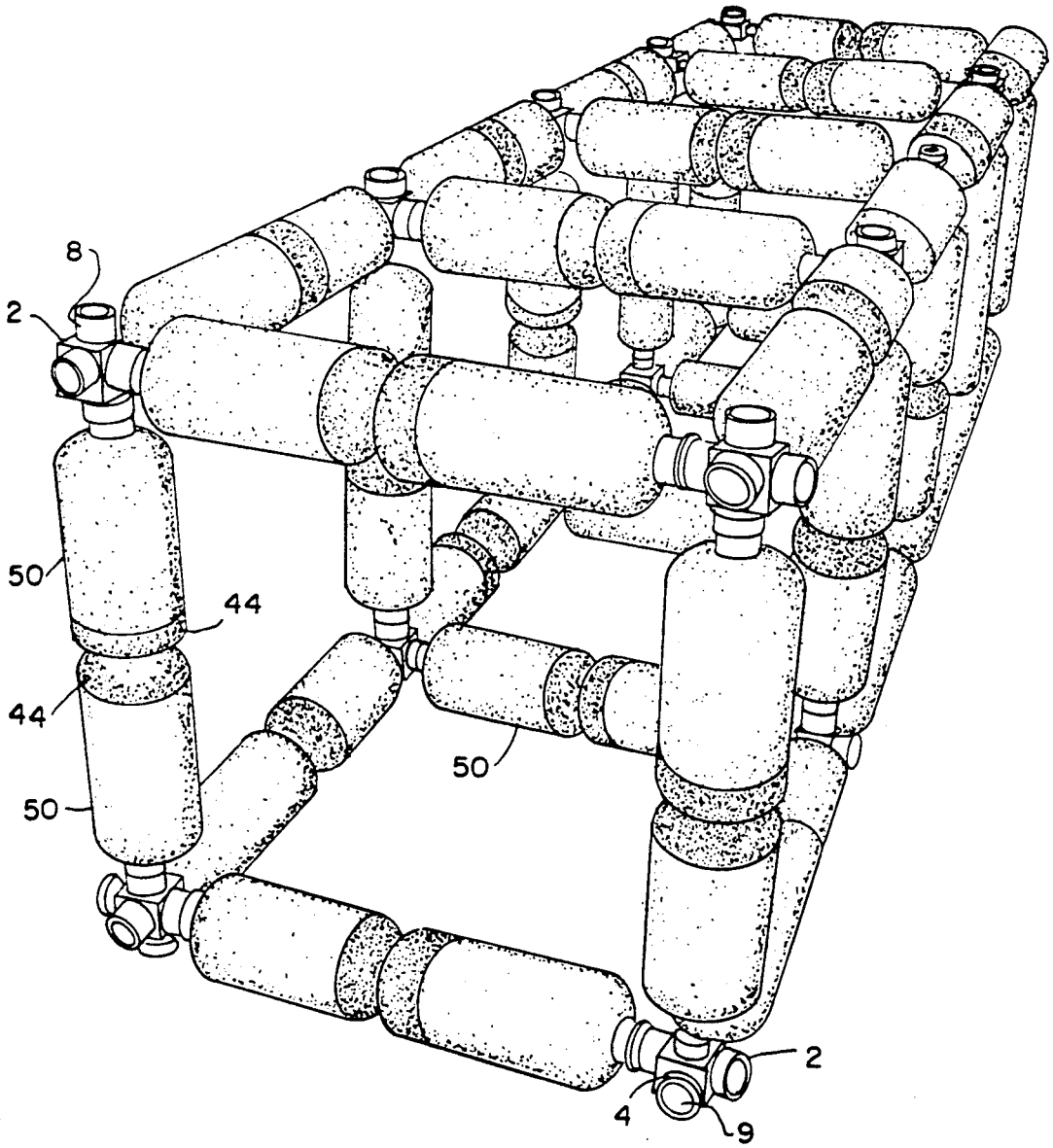
FIG. 17 is a cross-sectional view of a structure created using the connector system.

FIG. 17 shows a structure constructed with plastic bottles 50 connected to one another using cubes 2 and rivets. The bottle caps are secured in the extending receivers 8, and the base cups 44 are secured to one another using rivets.

The invention may be used to form toys, bookshelves, desks or other furniture, or shelter frames or floats and docks, among many uses.

While the invention has been described with reference to specific embodiments, modifications and variations of the invention may be constructed without departing from the scope of the invention, which is defined in the following claims.

I claim:

1. A connector system for creating structures from plastic bottles comprising a flat cruciform blank subdivided into six equivalent square panels joined by living hinges, each of the panels incorporating an outwardly extending cylinder, wherein each cylinder has an aperture equivalent to a bottle cap and incorporates an interior lock for holding a bottle cap, all cylinders protruding from one side of the cruciform blank, the cruciform blank being foldable into a cube having sides formed by the square panels with the cylinders extending outward, mating snaps on edges of the panels for holding the cube intact, said cube providing means for holding six bottle caps with cap-connected bottles extending therefrom, and plural rivets for insertion into preformed openings in base cups of the bottles for securing one bottle base cup to another bottle base cup.

2. The system of claim 1, further comprising guides outwardly extending from the panels oppositely to the cylinders for blocking apertures in the panels to prevent inward egress of the caps.

3. The system of claim 1, wherein each lock comprises a circumferential, inwardly extending flange extending inward from the cylinder into the aperture for gripping a bottom edge of a bottle cap.

4. The system of claim 1, further comprising guides, the guides comprising mated arms which extend interiorly in the folded cube, each panel having one of a mated pair of arms on each of its edges, wherein a single arm describes a male guide and two adjacent arms describe a female guide extending inward into the cube from edges of the panels in the folded cube having paired guides for holding the panels of the cube at 90° angles to each other.

5. The system of claim 4, wherein the arms further comprise stops which extend across the opening of an aperture in the cylinder of an adjoining cube panel for preventing an inserted cap from pushing into the interior of the cube.

6. The connector system of claim 1, wherein each of the plural rivets comprise a shaft with heads on opposite ends of the shaft for insertion into preformed openings in bottle base caps, each of the rivets having a center flange and the shaft having two axially extending shaft portions formed on opposite sides of the flange, and extending in opposite directions away from one another.

7. The system of claim 6, further comprising axial slits through the shaft portions and heads, creating an opening and dividing each of the heads and shaft portions of the rivets into two spaced sections.

8. The system of claim 6, further comprising bases attached to opposite sides of the center flange, the shaft portions extending outward from the bases and extending outward away from the center flange, the bases being wider than the shaft portions and as wide as the heads.

9. A connector/system creating structures from plastic bottles, comprising a flat cruciform blank subdivided into six equivalent square panels joined by living hinges, each of the panels incorporating an outwardly extending cylinder, wherein each cylinder is diametrically equivalent and incorporating an interior lock for holding a bottle cap, all cylinders protruding from one side of the cruciform, the cruciform folding into a cube having each side prescribing a square panel with the cylinders extending outward, mated snaps on edges of the panels for holding the cube intact, said cube providing a means for holding six bottle caps with connected bottles extending orthogonally and radially, and plural rivets for inserting into preformed openings in base cups of the bottles to secure one bottle base cup to another bottle base cup; said cylinders extending outwardly and having apertures in the panels equivalent to the diameter of the caps; said interior cylinder locks being flange extensions circumscribing an inside edge of the cylinders; mated guides on panel edges for holding the panels of the cube at 90° angles to each other; said guides preventing the inserted bottle caps from pushing into the interior of the cube.

10. The system of claim 9, wherein each rivet is formed with two shafts extending from a central flange the shafts extending in opposite directions from one another.

11. The system of claim 10, further comprising slits through the middle of the shafts, creating an opening and dividing the shafts into two sections.

12. A structure formed of one, one and a half or two liter carbonated soft drink bottles having bottom end cups, comprising plural soft drink bottles having caps and bottom end cups and being arranged bottom to bottom and cap to cap, plural double-ended rivets connecting the bottom end cups of the bottles, and plural receivers, each having plural sockets for receiving the caps of the bottles.

13. The structure of claim 12, wherein the receivers comprise hollow blocks having sockets arranged in multiple directions for receiving and holding the caps, with the bottles extending from the receivers in multiple directions.

* * * * *